United States Patent [19]

Sumitomo et al.

[11] 4,314,605

[45] Feb. 9, 1982

[54] CONDENSER

[75] Inventors: Hiroyuki Sumitomo, Takatsuki; Masafumi Doi, Daito; Kazuyuki Kobayashi; Katsutoshi Fukami, both of Nara; Kenzo Kawanishi, Yao, all of Japan

[73] Assignee: Hisaka Works Ltd., Osaka, Japan

[21] Appl. No.: 770,562

[22] Filed: Feb. 22, 1977

[30] Foreign Application Priority Data

Feb. 28, 1976 [JP] Japan ..... 51-21553

[51] Int. Cl.[3] ..... F28B 9/08

[52] U.S. Cl. ..... 165/110; 165/166; 165/170

[58] Field of Search ..... 165/110, 111, 170, 166, 165/167; 62/285, 288, 289, 290

[56] References Cited

U.S. PATENT DOCUMENTS

| | | | |
|---|---|---|---|
| 1,726,458 | 8/1929 | Tellander | 165/170 |
| 2,099,665 | 11/1937 | Smith | 165/110 |
| 2,587,116 | 2/1952 | Clay | 165/170 |
| 3,383,878 | 5/1968 | Booth | 62/285 |
| 3,840,070 | 10/1974 | Becker et al. | 165/110 |

FOREIGN PATENT DOCUMENTS

| | | | |
|---|---|---|---|
| 2102976 | 8/1972 | Fed. Rep. of Germany | 165/110 |

*Primary Examiner*—Sheldon J. Richter
*Attorney, Agent, or Firm*—Hall & Houghton

[57] ABSTRACT

A condenser characterized in that a pair of heat transmitting surfaces having opposed longitudinal grooves are arranged with the ridges of the longitudinal grooves contacted with or closely adjacent to each other to define steam passageways by said opposed longitudinal grooves so that the condensate in the opposed longitudinal grooves is collected in the contacted regions or between the closely adjacent regions by surface tension and allowed to flow down.

1 Claim, 8 Drawing Figures

CONDENSER

BRIEF DESCRIPTION OF THE INVENTION a. Field of the Invention

The present invention relates to a condenser of the plate, tube or other type.

b. Description of the Prior Art

Many of the plate type condensers now in use have been developed from the plate type heat exchanger for liquid-to-liquid use only. In improving the heat transmitting performance of such condensers, what becomes a problem is the film coefficient which indicates the ease of heat transmission in a heat transmitting surface. The film coefficient is defined as the heat conductivity of the liquid film divided by the thickness of the liquid film, i.e., it is determined by the condition in which condensate adheres to the heat transmitting surface. Thus, if steam is fed to a heat transmitting surface constituting a steam channel, a film of condensate is formed on the entire area of the heat transmitting surface. As condensation continues to proceed, this film becomes gradually thicker and eventually flows down along the vertical heat transmitting surface under its own weight and/or by the dynamic pressure of the steam. This downflow liquid layer gradually becomes thicker toward its lower end and the heat transmitting surface covered with the downflow liquid layer is prevented from contact with steam and since the thickness of the liquid film is increased, the film coefficient in that region is considerably decreased, greatly lowering the heat transmitting performance. Therefore, in order to improve the heat transmitting performance of the entire heat transmitting surface on which steam condenses, it is necessary to take measures to minimize the area of the filmy downflow liquid layer and prevent its thickness from being greatly increased.

If the heat transmitting surface is smooth, the abovedescribed filmy downflow liquid layer necessarily increases in amount and becomes thicker toward its lower region, so that it is necessary to take some measures, such as providing a water collecting groove for collecting the downflow liquid layer on the way. While such idea has been known, it has been impossible to develop sufficient heat transmitting performance. In view of the disadvantages inherent in the above-described measures and in the smooth heat transmitting surface, the applicant has proposed a condenser having a corrugated heat transmitting surface along with the present invention. This heat transmitting surface, as shown in FIGS. 1 and 2, has longitudinal grooves 2 in several lines on the side facing the steam passageways and water collectors 2' dividing said longitudinal grooves to provide alternating groups of such grooves, the arrangement being such that the condensate film formed on the heat transmitting surface 1 is collected in the valleys 2*a* of the longitudinal grooves 2 by making use of surface tension. More particularly, if the radii of the valleys 2*a* and ridges 2*b* of the grooves 2 are at proper values, the condensed steam on the ridges 2*b* is drawn to the condensate (downflow layer) in the valleys 2*a* by the action of surface tension. The condensate collected in the valleys 2*a* then flows down under its own weight. Thereafter, these bodies of condensate are collected at a given place by the water collectors disposed at fixed intervals and then discharged therefrom. Eventually, the area of the downflow liquid layer on the heat transmitting surface is considerably reduced, improving the heat transmitting performance.

SUMMARY OF THE INVENTION

The present invention is capable of improving minimization of the downflow liquid layer by surface tension in the longitudinal grooves in the heat transmitting surface and providing for stabilization of operation by opposed arrangement of steam passageways and condensate downflow channels, wherein a pair of surfaces having opposed longitudinal grooves are arranged with the ridges (convex portions) of the longitudinal grooves contacted with or closely adjacent to each other to define steam passageways by said opposed longitudinal grooves so that the condensate in the longitudinal grooves is collected in the contacted regions or between the closely adjacent regions by surface tension, which is a first point of the invention. A second point is that channels for allowing condensate to flow down are formed in advance between the closely adjacent regions of the heat transmitting surfaces.

FEATURES OF THE INVENTION

According to the present invention, since the condensate in the longitudinal grooves of the heat transmitting surfaces constituting steam passageways is collected in the contacted regions or between the closely adjacent regions at the ridges of the longitudinal grooves by surface tension and flows down, the area of the downflow liquid layer in each longitudinal groove can be minimized. Therefore, a superior condenser having an improved film coefficient and overall coefficient of heat transfer. Further, since the condensate is more effectively collected in the channels provided in the closely adjacent regions of the heat transmitting surfaces and flows down, attainment of more improved overall coefficient of heat transfer becomes possible.

DESCRIPTION OF THE PREFERRED EMBODIMENTS

Figure 3:
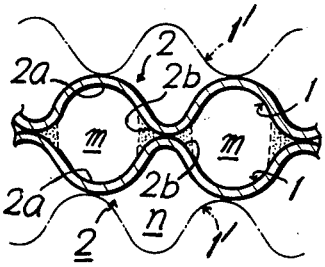
FIGS. 3 through 8 are cross-sectional views of the principal portions of heat transmitting surfaces illustrating concrete examples of the present invention.

First of all, the basic arrangement of the present invention will be described with reference to, for example, the plate type. In FIG. 3, designated at 1, 1 are a pair of heat transmitting surfaces and 2 designates longitudinal grooves opposed to each other and formed on the side of the heat transmitting surfaces 1, 1 facing steam passageways, with their valleys and ridges designated at 2*a* and 2*b*, respectively. In this case, the pair of heat transmitting surfaces 1, 1 are put together, with their longitudinal-groove ridges 2*b*, 2*b* contacted with each other, so that tubular regions defined by the longitudinal grooves 2, 2 serve as steam passageways m. Further, other heat transmitting surfaces 1' are arranged with their back contacted (or closely adjacent to) the back of the heat transmitting surfaces 1 so that channels n defined therebetween may be used as passageways for a cooling liquid.

Figure 1:
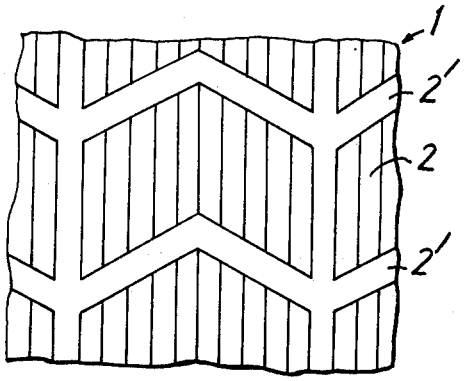
FIGS. 1 and 2 show the conditions of a heat transmitting surface before it is improved according to the present invention, FIG. 1 being a front view and FIG. 2 being an enlarged cross-sectional view of the principal portion.
Figure 2:
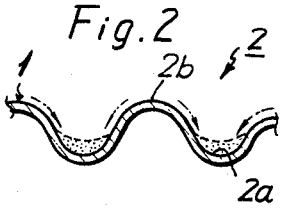

What is important is the size of the longitudinal grooves 2 of the heat transmitting surfaces 1, and it should be such that the condensate formed in the valleys 2*a* is drawn to the contacted regions of the ridges 2*b* by surface tension. More particularly, surface tension is utilized in the direction opposite to that in which it is utilized in FIG. 2 and this can be easily realized since the condensate necessarily collects at the contacted regions of the ridges 2*b*. For example, if steam is passed to the channels m at the beginning of condensing operation, a thin film of condensate is formed on the surface of each longitudinal groove 2, and as condensation proceeds, the strong surface tension of the condensate film at each contacted region causes the condensate therearound to be drawn thereto and the condensate in the valley 2*a* to collect at the contacted region 2*b*, so that there is no possibility of a downflow liquid layer being formed in the valley 2*a*. Further, in the contacted regions, the collected condensate flows down under its own weight. Thus, the contacted regions of the ridges 2*b* serve as passageways for condensate and hence the film coefficient on the heat transmitting surfaces is maintained at a high value.

Figure 4:
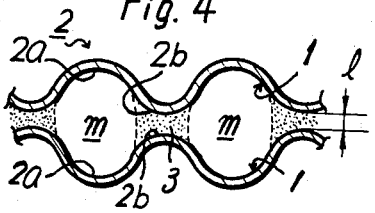

In the embodiment shown in FIG. 3, the condensate collects at the contacted regions of the ridges 2*b* and flows down, but as an example in which such collection and flowing down are made more effective, there is an embodiment shown in FIG. 4. In the case of FIG. 4, the ridges 2*b*, 2*b* of a pair of heat transmitting surfaces 1, 1 are disposed closely adjacent to each other with a clearance 1 therebetween rather than being contacted with each other. The condensate is collected with greater force in such closely adjacent region 3 by making use of the so-called capillary action. In this case, the amount of condensate which is collected is greater by the volume of the closely adjacent region 3 than in the case of FIG. 3, so that it flows down more securely, and since the area of the downflow liquid layer is smaller, further improvement of film coefficient can be attained.

Figure 5:
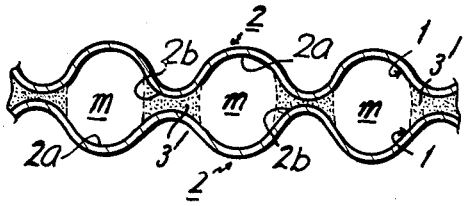

In the case of FIG. 4, positional control is all the more difficult because the heat transmitting surfaces 1, 1 are put together closely adjacent to each other, but as an approach to this problem a system shown in FIG. 5, which is a combination of the systems shown in FIGS. 3 and 4, may be used. In the FIG. 5 embodiment, contact and close adjacency in arrangement of the ridges 2*b*, 2*b* alternate with each other, thus facilitating dimensional control of the closely adjacent regions 3'. Although contact and close adjacency alternate with each other in this case, the arrangement may be such as, for example, contact—close adjacency—close adjacency—contact—close adjacency and so on.

Figure 6:
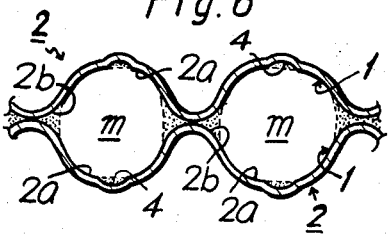

In the above embodiments, the condensate in the valleys 2*a* is drawn to the ridges 2*b* by surface tension. Surface tension becomes greater as the bottom of the valleys 2*a* is approached, so that there is the danger of a downflow liquid layer being formed on the bottom of the valleys 2*a*. The larger the radius of curvature of the valleys 2*a*, the greater the possibility of such downflow liquid layer being formed, and this can result in the lowering of film coefficient. Therefore, in such case an embodiment shown in FIG. 6 is used. The arrangement shown in FIG. 6 is suitable when the valleys 2*a* are relatively large, the essence being to form small valley grooves 4 in the bottom of the valleys 2*a*. That is, if a downflow liquid film is formed on the bottom of the valleys 2*a*, such downflow liquid is allowed to collect in the small valley grooves 4 and then flow down. In other words, condensate is collected also in the small valley grooves 4, whereby the film coefficient at the valleys 2*a* of the longitudinal grooves 2 is maintained high. In addition, as for the arrangement of the ridges 2*b* in FIG. 6, contact or close adjacency or a combination thereof is employed.

Figure 8:
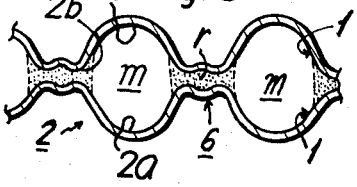
Figure 7:
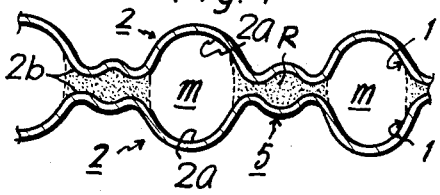

What has been described so far is the basic arrangement, and partial improvements therein, roughly divided, are in two forms shown in FIGS. 7 and 8. Thus, a pair of heat transmitting surfaces 1, 1 are provided with opposed longitudinal grooves 2, 2 and small longitudinal grooves 5, 5 or 6, 6 between such longitudinal grooves 2, 2, the heat transmitting surfaces being then put together closely adjacent to each other.

The arrangement shown in FIG. 7 will first be described. Longitudinal grooves 2, 2 in the heat transmitting surfaces 1, 1 put together closely adjacent to each other define steam passageways m while small longitudinal grooves 5, 5 define closely adjacent region channels R allowing condensate to flow down with ease under its own weight. The steam which is being condensed at the valleys 2*a* of the longitudinal grooves 2 is collected in the closely adjacent regions by making use of surface tension and then drawn into the closely adjacent region channels R, where it is allowed to flow down. In the case of FIG. 7, the closely adjacent region channels R are larger, or the small longitudinal grooves 5 are relatively larger than in the case of FIG. 8 so that the condensate collected in the closely adjacent region grooves R is allowed to flow down in the following manner. For example, there are two ways it flows down, one in which it flows down under gravity and the other in which it is forced to flow down as by vacuum suction or by pouring water from above. In brief, in the case of FIG. 7, the size of the closely adjacent region channels R is set to a value such that natural or forced flowing-down takes place easily as described above. Then, the condensate will flow down more concentratedly and rapidly.

As for the arrangement shown in FIG. 8, the principle of operation involved is entirely different from that of the arrangement shown in FIG. 7. More particularly, the closely adjacent region channels r defined by the small longitudinal grooves 6 are in a small tubular form which prevents natural or forced flowing-down of condensate. Thus, the construction of the closely adjacent region channels r is such that capillary action can be utilized. Then, it is assured that condensate will always fill the closely adjacent region channels r to a substantially constant level, so that as soon as an amount of fresh condensed steam from the valley 2*a* enters the closely adjacent region channel r, the same amount of condensate flows out of the lowermost end of the closely adjacent region channel r. This results in effective flowing-down of the condensate.

The foregoing description and the drawing refer to the plate type, but the present invention is also applicable to the tube type and volute type condensers, in which case heat transmitting tubes or the like are provided with longitudinal grooves and put together in the manner described above.

We claim :

1. A rectilinear plate type condenser construction comprising a pair of condenser elements placed in opposed relationship to one another, each of said condenser elements having a condensing and heat transmitting plate surface in opposed relationship to one another along which a steam condensate will flow in the form of a film, the plate surface of each condenser element having a plurality of laterally spaced longitudinally extending grooves therein thereby forming longitudinally extending valleys and ridges in alternating relationship to one another on the plate surface of each condenser element, said grooves being in substantially right angle relationship to the top of each of said plate elements, the longitudinally extending ridges of one condenser element being in longitudinal alignment with and at least in close opposed relationship to the longitudinally extending ridges of the other condenser element, thereby permitting the opposed valleys of each condenser element to form a plurality of vertically extending steam passageways in the condenser whereby the condensate in each formed vertically extending steam passageway is collected in the area at which each of the opposed ridges of the opposed condenser elements are in at least close engagement with one another, wherein each of the longitudinally extending ridges of each condenser element in opposed and at least close relationship to one another is each provided with a small, longitudinally extending, vertical groove thereby forming small, vertical, tubular channels therein which will run in parallel relationship to the formed, vertically extending steam passageways of said condenser whereby the condensate from the formed steam passageways will be collected in said tubular channels and will then flow downwardly therein.

* * * * *